US012379173B1

(12) United States Patent
Fair

(10) Patent No.: US 12,379,173 B1
(45) Date of Patent: Aug. 5, 2025

(54) BULLET CASING IMPACT REDUCER

(71) Applicant: Jared Andrew Fair, Cairo, OH (US)

(72) Inventor: Jared Andrew Fair, Cairo, OH (US)

( * ) Notice: Subject to any disclaimer, the term of this patent is extended or adjusted under 35 U.S.C. 154(b) by 0 days.

(21) Appl. No.: 18/218,077

(22) Filed: Jul. 4, 2023

Related U.S. Application Data

(60) Provisional application No. 63/358,828, filed on Jul. 6, 2022.

(51) Int. Cl.
*F41A 9/60* (2006.01)

(52) U.S. Cl.
CPC ..... *F41A 9/60* (2013.01)

(58) Field of Classification Search
CPC ..... F41A 9/60
USPC ..... 42/98; 89/33.4
See application file for complete search history.

(56) References Cited

U.S. PATENT DOCUMENTS

| | | | | |
|---|---|---|---|---|
| 706,315 | A * | 8/1902 | Greene | A47H 23/01 160/393 |
| 3,658,241 | A | 4/1972 | Pistocchi | |
| 4,296,565 | A | 10/1981 | Jaffin et al. | |
| 6,354,035 | B1 | 3/2002 | Niebuhr et al. | |
| 7,043,863 | B2 | 5/2006 | Saur | |
| D578,598 | S | 10/2008 | Anderson | |
| 7,980,166 | B1 * | 7/2011 | Fuqua | F41H 5/24 86/50 |
| 9,366,491 | B1 | 6/2016 | Baxley | |
| 10,107,578 | B1 | 10/2018 | Mirabel | |
| 2003/0221354 | A1 | 12/2003 | Goza et al. | |
| 2003/0221355 | A1 | 12/2003 | Castaldo | |
| 2007/0084568 | A1 * | 4/2007 | Nien | A47H 23/06 160/85 |
| 2013/0192450 | A1 | 8/2013 | Lalor | |
| 2019/0000257 | A1 * | 1/2019 | Locklear | E06B 7/26 |
| 2021/0278176 | A1 * | 9/2021 | Merritt, II | F41H 5/013 |

FOREIGN PATENT DOCUMENTS

| | | | | |
|---|---|---|---|---|
| CH | 679607 | A5 * | 3/1992 | F41A 9/30 |
| DE | 4321213 | A1 * | 1/1995 | E04F 13/0867 |

* cited by examiner

*Primary Examiner* — Bret Hayes
(74) *Attorney, Agent, or Firm* — The Law Office of Patrick F. O'Reilly III, LLC

(57) ABSTRACT

A bullet casing impact reducer is disclosed herein. The bullet casing impact reducer includes an upper frame member and a flexible drape member configured to be hung from the upper frame member so as to extend downwardly from the upper frame member, the flexible drape member configured to absorb an impact of a bullet casing after the bullet casing is expelled from a firearm so as to reduce a likelihood that the bullet casing is deflected back towards a shooter of the firearm. In some embodiments, the bullet casing impact reducer further includes a lower frame member configured to be mounted at a bottom end of the flexible drape member, and the lower frame member and a looped lower end portion of the flexible drape member configured to collectively form a collection bin for receiving bullet casings after the bullet casings are expelled from the firearm.

18 Claims, 2 Drawing Sheets

Bullet Casing Impact Reducer

BULLET CASING IMPACT REDUCER

CROSS-REFERENCE TO RELATED APPLICATIONS

This patent application claims priority to, and incorporates by reference in its entirety, U.S. Provisional Patent Application No. 63/358,828, entitled "Bullet Casing Impact Reducer", filed on Jul. 6, 2022.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a bullet casing impact reducer. More particularly, the invention relates to a bullet casing impact reducer that is configured to absorb an impact of a bullet casing after the bullet casing is expelled from a firearm so as to reduce a likelihood that the bullet casing is deflected back towards a shooter of the firearm.

2. Background

During the shooting of a firearm, particularly during the shooting of a semi-automatic or automatic firearm, bullet casings are rapidly expelled from a side of the firearm. Because these bullet casings are being ejected from the firearm at a high rate of speed, these bullet casings tend to ricochet off any objects that are in proximity to the firearm that is being discharged. This is particularly a problem when the firearm is being discharged by the shooter in a confined space, such as in an indoor shooting range. The ricocheting of bullet casings during the shooting of the firearm poses a safety hazard for the shooter because these bullet casings can strike a body portion of the shooter, such as the shooter's neck or head, during the discharging of the firearm. In addition, the rapid expulsion of the bullet casings from the firearm can pose an additional slipping hazard to the shooter because these bullet casings are expelled directly onto the floor of the shooting range.

Therefore, what is needed is a bullet casing impact reducer that reduces a likelihood that bullet casings discharged from a firearm are deflected back towards a shooter of the firearm. Further, a bullet casing impact reducer is needed that collects bullet casings discharged from a firearm so that these bullet casings are not expelled directly onto the floor around the shooter.

BRIEF SUMMARY OF EMBODIMENTS OF THE INVENTION

Accordingly, the present invention is directed to a bullet casing impact reducer that substantially obviates one or more problems resulting from the limitations and deficiencies of the related art.

In accordance with one or more embodiments of the present invention, there is provided a bullet casing impact reducer that comprises an upper frame member, the upper frame member configured to be mounted to a wall or ceiling of a structure; and a flexible drape member, the flexible drape member configured to be hung from the upper frame member so as to extend downwardly from the upper frame member, the flexible drape member configured to absorb an impact of a bullet casing after the bullet casing is expelled from a firearm so as to reduce a likelihood that the bullet casing is deflected back towards a shooter of the firearm.

In a further embodiment of the present invention, the upper frame member is in a form of a mounting bracket member that includes a plurality of first fastener apertures for receiving respective fastener members that secure the upper frame member to the wall or ceiling of the structure.

In yet a further embodiment, the bullet casing impact reducer further comprises an upper drape rod configured to be supported on the upper frame member, the flexible drape member configured to be hung from the upper frame member by means of being suspension mounted from the upper drape rod.

In still a further embodiment, the upper frame member comprises a pair of spaced-apart notches formed therein for receiving oppositely disposed end portions of the upper drape rod.

In yet a further embodiment, the upper frame member further comprises a pair of adjustment bracket members disposed beneath and supporting the upper drape rod, each of the adjustment bracket members being disposed on a respective opposite side of the upper frame member, and each of the adjustment bracket members configured to be used for adjusting an alignment of the flexible drape member so as to enable the flexible drape member to be leveled after the flexible drape member is hung from the upper frame member.

In still a further embodiment, the bullet casing impact reducer further comprises a lower frame member configured to be mounted at a bottom end of the flexible drape member, the lower frame member configured to be mounted to the wall of the structure, and the lower frame member and a looped lower end portion of the flexible drape member configured to collectively form a collection bin for receiving bullet casings after the bullet casings are expelled from the firearm.

In yet a further embodiment, the lower frame member is in a form of a wall bracket member that includes a plurality of second fastener apertures for receiving respective fastener members that secure the lower frame member to the wall of the structure.

In still a further embodiment, the bullet casing impact reducer further comprises a lower drape rod configured to be supported on the lower frame member, the bottom end of the flexible drape member configured to be attached to the lower drape rod, and the looped lower end portion of the flexible drape member configured to be disposed beneath the lower drape rod so as to form a flexible bottom of the collection bin.

In yet a further embodiment, the lower frame member comprises a pair of spaced-apart notches formed therein for receiving oppositely disposed end portions of the lower drape rod.

In still a further embodiment, the bullet casing impact reducer further comprises a tension rod configured to be supported on the lower frame member, the looped lower end portion of the flexible drape member configured to be looped around the tension rod so that the flexible drape member is held generally taut within the lower frame member.

In accordance with one or more other embodiments of the present invention, there is provided a bullet casing impact reducer that comprises an upper frame member, the upper frame member configured to be mounted to a wall or ceiling of a structure; a flexible drape member, the flexible drape member configured to be hung from the upper frame member so as to extend downwardly from the upper frame member, the flexible drape member configured to absorb an impact of a bullet casing after the bullet casing is expelled from a firearm so as to reduce a likelihood that the bullet casing is deflected back towards a shooter of the firearm; and a lower frame member configured to be mounted at a bottom end of the flexible drape member, the lower frame member configured to be mounted to the wall of the structure, and the lower frame member and a looped lower end portion of the flexible drape member configured to collectively form a collection bin for receiving bullet casings after the bullet casings are expelled from the firearm.

In a further embodiment of the present invention, the upper frame member is in a form of a mounting bracket member that includes a plurality of first fastener apertures for receiving respective fastener members that secure the upper frame member to the wall or ceiling of the structure.

In yet a further embodiment, the bullet casing impact reducer further comprises an upper drape rod configured to be supported on the upper frame member, the flexible drape member configured to be hung from the upper frame member by means of being suspension mounted from the upper drape rod.

In still a further embodiment, the upper frame member comprises a pair of spaced-apart notches formed therein for receiving oppositely disposed end portions of the upper drape rod.

In yet a further embodiment, the upper frame member further comprises a pair of adjustment bracket members disposed beneath and supporting the upper drape rod, each of the adjustment bracket members being disposed on a respective opposite side of the upper frame member, and each of the adjustment bracket members configured to be used for adjusting an alignment of the flexible drape member so as to enable the flexible drape member to be leveled after the flexible drape member is hung from the upper frame member.

In still a further embodiment, the lower frame member is in a form of a wall bracket member that includes a plurality of second fastener apertures for receiving respective fastener members that secure the lower frame member to the wall of the structure.

In yet a further embodiment, the bullet casing impact reducer further comprises a lower drape rod configured to be supported on the lower frame member, the bottom end of the flexible drape member configured to be attached to the lower drape rod, and the looped lower end portion of the flexible drape member configured to be disposed beneath the lower drape rod so as to form a flexible bottom of the collection bin.

In still a further embodiment, the lower frame member comprises a pair of spaced-apart notches formed therein for receiving oppositely disposed end portions of the lower drape rod.

In yet a further embodiment, the bullet casing impact reducer further comprises a tension rod configured to be supported on the lower frame member, the looped lower end portion of the flexible drape member configured to be looped around the tension rod so that the flexible drape member is held generally taut within the lower frame member.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
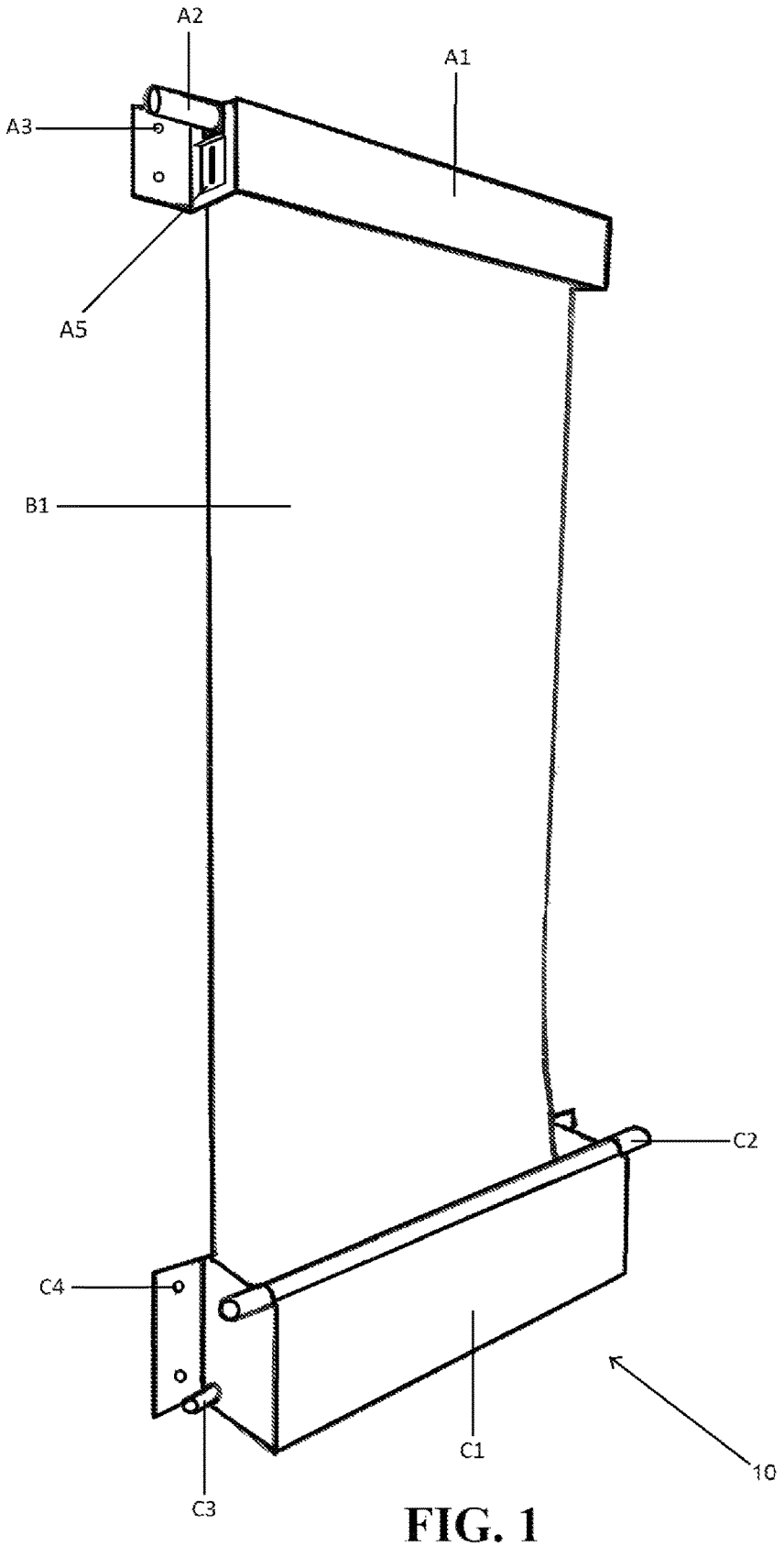
FIG. 1 is an assembled perspective view of a bullet casing impact reducer, according to an illustrative embodiment of the invention.
Figure 2:
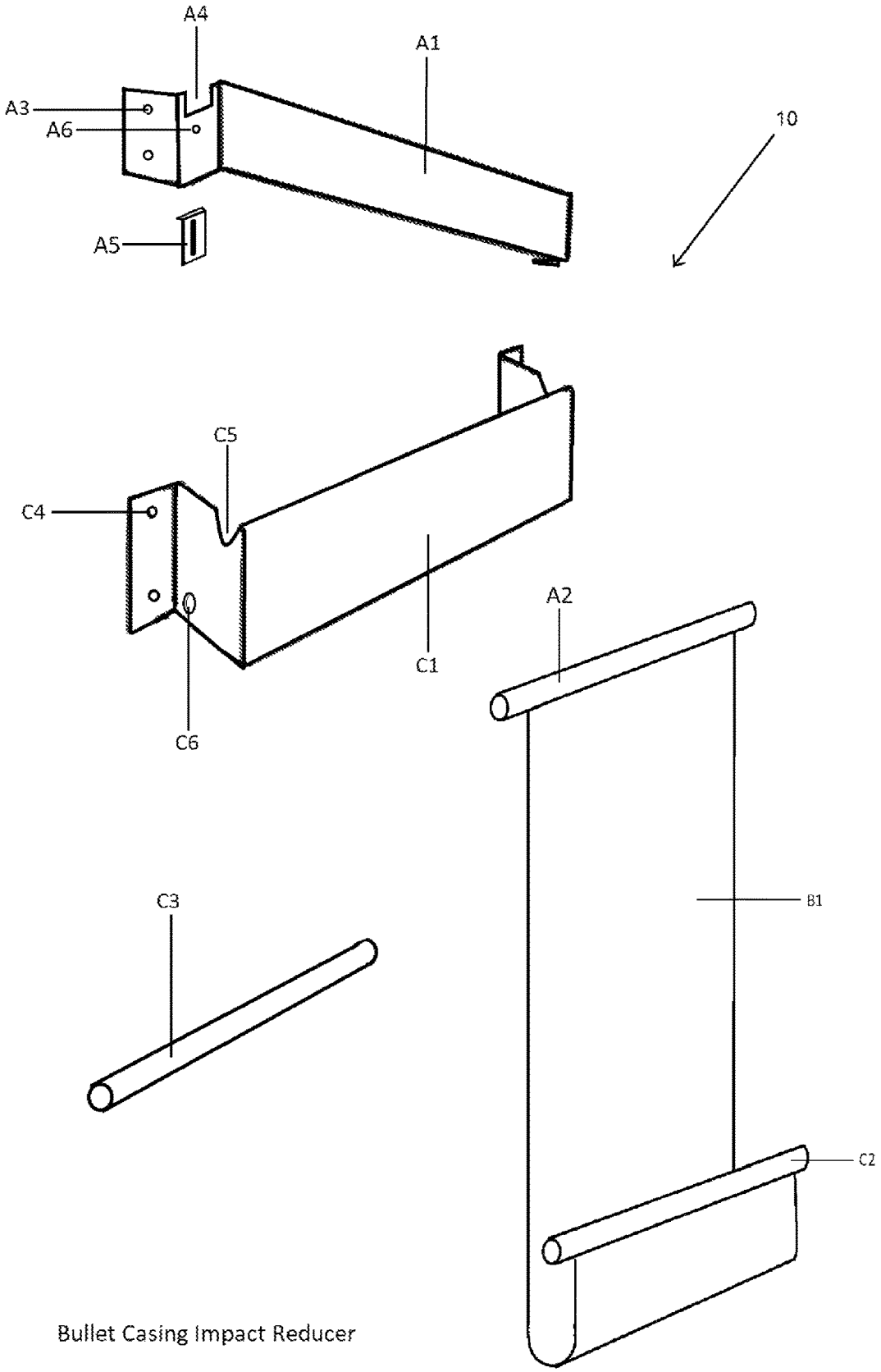
FIG. 2 is an exploded perspective view of the bullet casing impact reducer of FIG. 1.

An illustrative embodiment of a bullet casing impact reducer is seen generally at 10 in FIGS. 1 and 2. With initial reference to FIG. 1, it can be seen that the bullet casing impact reducer 10 generally comprises an upper frame member A1, the upper frame member A1 configured to be mounted to a wall of a structure (e.g., to a wall of a building); and a flexible drape member B1, the flexible drape member B1 hung from the upper frame member A1 so as to extend downwardly from the upper frame member A1, the flexible drape member B1 configured to absorb an impact of a bullet casing after the bullet casing is expelled from a firearm so as to reduce a likelihood that the bullet casing is deflected back towards a shooter of the firearm. In the illustrative embodiment, referring again to FIG. 1, the bullet casing impact reducer 10 may further comprise a lower frame member C1 mounted at a bottom end of the flexible drape member B1, the lower frame member C1 configured to be mounted to the wall of the structure (e.g., to the wall of the building), and the lower frame member C1 and a looped lower end portion of the flexible drape member B1 configured to collectively form a collection bin for receiving bullet casings after the bullet casings are expelled from the firearm.

In the illustrative embodiment, referring to FIGS. 1 and 2, it can be seen that the upper frame member A1 is in a form of a mounting bracket member that includes a plurality of first fastener apertures A3 for receiving respective fastener members (e.g., screws or bolts) that secure the upper frame member A1 to the wall of the structure (e.g., to the wall of the building). In the illustrative embodiment, as best shown in FIG. 2, the upper frame member A1 is in a form of a generally U-shaped mounting bracket member with oppositely disposed flange portions that include fastener apertures A3. In the illustrative embodiment, each opposed flange portion of the upper frame member A1 comprises a pair of vertically spaced-apart fastener apertures A3 (see FIGS. 1 and 2).

In an alternative embodiment, rather than being mounted to the wall, the upper frame member A1 may be used for securing the bullet casing impact reducer 10 to a ceiling of the structure (e.g., to a ceiling of the building). For example, the ceiling may have a pair of downwardly extending tabs to which the upper frame member A1 is attached.

Referring again to FIGS. 1 and 2, in the illustrative embodiment, the bullet casing impact reducer 10 further comprises an upper drape rod A2 supported on the upper frame member A1. In the illustrative embodiment, the flexible drape member B1 is hung from the upper frame member A1 by means of being suspension mounted from the upper drape rod A2. As best shown in FIG. 2, the flexible drape member B1 is attached to the upper drape rod A2, and hangs downwardly from the upper drape rod A2. Also, as shown in the illustrative embodiment of FIG. 2, the upper frame member A1 comprises a pair of spaced-apart notches A4 formed therein for receiving oppositely disposed end portions of the upper drape rod A2.

In the illustrative embodiment, turning again to FIGS. 1 and 2, it can be seen that the upper frame member A1 further comprises a pair of adjustment bracket members A5 disposed beneath and supporting the upper drape rod A2. Each of the adjustment bracket members A5 is disposed on a respective opposite side of the upper frame member A1, and each of the adjustment bracket members is configured to be used for adjusting an alignment of the flexible drape member B1 so as to enable the flexible drape member B1 to be leveled after the flexible drape member B1 is hung from the upper frame member A1. As shown in the illustrative embodiment of FIGS. 1 and 2, each adjustment bracket member A5 may comprise a vertically extending slot for receiving a respective fastener member (e.g., screw or bolt). The fastener member extends through the slot of the adjustment bracket member A5, and into a circular fastener aperture A6 provided in an opposed side of the upper frame member A1. In order to adjust the height of the adjustment bracket member A5, a user loosens the fastener member enough to permit the adjustment bracket member A5 to be slid relative to the side of the upper frame member A1 (i.e., vertically extending slot in the adjustment bracket member A5 allows the adjustment bracket member A5 to be slid up or down relative to the fastener member). Once the desired height of the adjustment bracket member A5 is achieved, the head of the fastener member is tightened against the adjustment bracket member A5 so as to fix the adjustment bracket member A5 in place. In this way, the adjustment bracket members A5 allow the opposite end portions of the upper drape rod A2 to be raised or lowered so as to allow the flexible drape member B1 to be leveled relative to a floor surface of the building in which the bullet casing impact reducer 10 is disposed.

In the illustrative embodiment, referring to FIGS. 1 and 2, it can be seen that the lower frame member C1 is in a form of a wall bracket member that includes a plurality of second fastener apertures C4 for receiving respective fastener members (e.g., screws or bolts) that secure the lower frame member C1 to the wall of the structure (e.g., to the wall of the building). In the illustrative embodiment, as best shown in FIG. 2, the lower frame member C1 is in a form of a generally U-shaped wall bracket member with oppositely disposed flange portions that include fastener apertures C4. In the illustrative embodiment, each opposed flange portion of the lower frame member C1 comprises a pair of vertically spaced-apart fastener apertures C4 (see FIGS. 1 and 2).

Referring again to FIGS. 1 and 2, in the illustrative embodiment, the bullet casing impact reducer 10 further comprises a lower drape rod C2 supported on the lower frame member C1. In the illustrative embodiment, the bottom end of the flexible drape member B1 is attached to the lower drape rod C2, and the looped lower end portion of the flexible drape member B1 is disposed beneath the lower drape rod C2 (see FIG. 2) so as to form a flexible bottom of the collection bin. Also, as shown in the illustrative embodiment of FIG. 2, the lower frame member C1 comprises a pair of spaced-apart notches C5 formed therein for receiving oppositely disposed end portions of the lower drape rod C2.

In the illustrative embodiment, the bullet casing impact reducer 10 further comprises a tension rod C3 supported on the lower frame member C1 (refer to FIGS. 1 and 2). More specifically, the oppositely disposed side walls of the lower frame member C1 are each provided with a circular aperture C6 for accommodating a respective end of the tension rod C3 (see FIG. 2). In the illustrative embodiment, the looped lower end portion of the flexible drape member B1 is looped around the tension rod C3 so that the flexible drape member B1 is held generally taut within the lower frame member C1. In other words, the tension rod C3 allows the flexible drape member B1 to be held in tension between the upper frame member A1 and the lower frame member C1 so that the flexible drape member B1 is able to more effectively absorb the impact of a bullet casing expelled from a firearm.

In the illustrative embodiment, the flexible drape member B1 may be formed from a suitable utility fabric material, such a utility laminate material with a polyester face and a polyvinyl chloride (PVC) back (e.g., a Pro-Tuff utility fabric). In the illustrative embodiment, the other components of the bullet casing impact reducer 10, such as the upper frame member A1 and the lower frame member C1, may be formed from a suitable metal or plastic. In alternative embodiments, other suitable materials may be used to form the components of the bullet casing impact reducer 10.

It is readily apparent that the aforedescribed bullet casing impact reducer 10 offers numerous advantages. As one example, the bullet casing impact reducer 10 reduces a likelihood that bullet casings discharged from a firearm are deflected back towards a shooter of the firearm. In addition, the bullet casing impact reducer 10 collects bullet casings discharged from a firearm so that these bullet casings are not expelled directly onto the floor around the shooter.

Advantageously, the bullet casing impact reducer 10 described above reduces the possibility that bullet casings expelled from a semi-automatic or fully automatic firearm (e.g., a semi-automatic or fully automatic rifle) will be deflected back towards the shooter of the firearm. The bullet casing impact reducer 10 is particularly useful in confined areas, such as those found in an indoor shooting range. As described above, the flexible drape member B1 held in tension by the tension rod C3 sufficiently absorbs the impact of the ejected bullet casings so that the motion of the casings is stopped, and the bullet casings fall by gravity into the collection bin formed by the lower frame member C1 and the looped lower end portion of the flexible drape member B1. As shown in FIG. 1, the flexible drape member B1 is hung from the upper frame member A1 and is connected to the lower frame member C1. In the arrangement of FIG. 1, the looped lower end portion of the flexible drape member B1 produces a pouch where the ejected bullet casings can be collected for the convenience and safety of the user.

In addition, because the collection bin of the bullet casing impact reducer 10 collects the ejected bullet casings after the motion of the ejected bullet casings is stopped by the flexible drape member B1, the bullet casing impact reducer 10 is able to potentially reduce slipping hazards for the shooter. Also, because the likelihood of the bullet casings being deflected back towards the shooter of the firearm is greatly reduced, the body of the shooter is afforded protection by the bullet casing impact reducer 10, thereby allowing the shooter to better focus and concentrate on the shooting target.

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A bullet casing impact reducer, comprising:

an upper frame member, the upper frame member configured to be mounted to a wall or ceiling of a structure;

a flexible drape member, the flexible drape member configured to be hung from the upper frame member so as to extend downwardly from the upper frame member, the flexible drape member being formed from a utility fabric material, the flexible drape member configured to absorb an impact of a bullet casing after the bullet casing is expelled from a firearm so as to reduce a likelihood that the bullet casing is deflected back towards a shooter of the firearm; and an upper drape rod configured to be supported on the upper frame member, the flexible drape member configured to be hung from the upper frame member by means of being suspension mounted from the upper drape rod;

wherein the upper frame member comprises a pair of spaced-apart notches formed therein for receiving oppositely disposed end portions of the upper drape rod; and wherein the upper frame member is in a form of a generally U-shaped mounting bracket member with oppositely disposed flange portions, and the spaced-apart notches in the upper frame member are in a form of spaced-apart, upwardly facing notches for receiving the oppositely disposed end portions of the upper drape rod, each of the spaced-apart, upwardly facing notches having a top opening such that a respective one of the oppositely disposed end portions of the upper drape rod is able to be inserted down into the upwardly facing notch.

2. The bullet casing impact reducer according to claim 1, wherein the upper frame member further comprises a plurality of first fastener apertures for receiving respective fastener members that secure the upper frame member to the wall or ceiling of the structure.

3. The bullet casing impact reducer according to claim 1, wherein the upper frame member further comprises a pair of adjustment bracket members disposed beneath 2 and supporting the upper drape rod, each of the adjustment bracket members being disposed on a 3 respective opposite side of the upper frame member, and each of the adjustment bracket members configured to be used for adjusting an alignment of the flexible drape member so as to enable the flexible drape member to be leveled after the flexible drape member is hung from the upper frame member.

4. The bullet casing impact reducer according to claim 1, further comprising a lower frame member configured to be mounted at a bottom end of the flexible drape member, the lower frame member configured to be mounted to the wall of the structure, and the lower frame member and a looped lower end portion of the flexible drape member configured to collectively form a collection bin for receiving bullet casings after the bullet casings are expelled from the firearm.

5. The bullet casing impact reducer according to claim 4, wherein the lower frame member is in a form of a wall bracket member that includes a plurality of second fastener apertures for receiving respective fastener members that secure the lower frame member to the wall of the structure.

6. The bullet casing impact reducer according to claim 4, further comprising a lower drape rod configured to be supported on the lower frame member, the bottom end of the flexible drape member configured to be attached to the lower drape rod, and the looped lower end portion of the flexible drape member configured to be disposed beneath the lower drape rod so as to form a flexible bottom of the collection bin.

7. The bullet casing impact reducer according to claim 6, wherein the lower frame member comprises a pair of spaced-apart notches formed therein for receiving oppositely disposed end portions of the lower drape rod.

8. The bullet casing impact reducer according to claim 6, further comprising a tension rod configured to be supported on the lower frame member, the looped lower end portion of the flexible drape member configured to be looped around the tension rod so that the flexible drape member is held generally taut within the lower frame member.

9. The bullet casing impact reducer according to claim 1, wherein the utility fabric material that forms the flexible drape member comprises a utility laminate material with a polyester face and a polyvinyl chloride (PVC) back.

10. A bullet casing impact reducer, comprising:

an upper frame member, the upper frame member configured to be mounted to a wall or ceiling of a structure;

a flexible drape member, the flexible drape member configured to be hung from the upper frame member so as to extend downwardly from the upper frame member, the flexible drape member configured to absorb an impact of a bullet casing after the bullet casing is expelled from a firearm so as to reduce a likelihood that the bullet casing is deflected back towards a shooter of the firearm; and a lower frame member configured to be mounted at a bottom end of the flexible drape member, the lower frame member configured to be mounted to the wall of the structure, and the lower frame member and a looped lower end portion of the flexible drape member configured to collectively form a collection bin for receiving bullet casings after the bullet casings are expelled from the firearm.

11. The bullet casing impact reducer according to claim 10, wherein the upper frame member is in a form of a mounting bracket member that includes a plurality of first fastener apertures for receiving respective fastener members that secure the upper frame member to the wall or ceiling of the structure.

12. The bullet casing impact reducer according to claim 10, further comprising an upper drape rod configured to be supported on the upper frame member, the flexible drape member configured to be hung from the upper frame member by means of being suspension mounted from the upper drape rod.

13. The bullet casing impact reducer according to claim 12, wherein the upper frame member comprises a pair of spaced-apart notches formed therein for receiving oppositely disposed end portions of the upper drape rod.

14. The bullet casing impact reducer according to claim 12, wherein the upper frame member further comprises a pair of adjustment bracket members disposed beneath and supporting the upper drape rod, each of the adjustment bracket members being disposed on a respective opposite side of the upper frame member, and each of the adjustment bracket members configured to be used for adjusting an alignment of the flexible drape member so as to enable the flexible drape member to be leveled after the flexible drape member is hung from the upper frame member.

15. The bullet casing impact reducer according to claim 10, wherein the lower frame member is in a form of a wall bracket member that includes a plurality of second fastener apertures for receiving respective fastener members that secure the lower frame member to the wall of the structure.

16. The bullet casing impact reducer according to claim 10, further comprising a lower drape rod configured to be supported on the lower frame member, the bottom end of the flexible drape member configured to be attached to the lower drape rod, and the looped lower end portion of the flexible drape member configured to be disposed beneath the lower drape rod so as to form a flexible bottom of the collection bin.

17. The bullet casing impact reducer according to claim 16, wherein the lower frame member comprises a pair of spaced-apart notches formed therein for receiving oppositely disposed end portions of the lower drape rod.

18. The bullet casing impact reducer according to claim 16, further comprising a tension rod configured to be supported on the lower frame member, the looped lower end portion of the flexible drape member configured to be looped around the tension rod so that the flexible drape member is held generally taut within the lower frame member.

* * * * *